United States Patent [19]

Kosup

[11] 3,986,155

[45] Oct. 12, 1976

[54] MODULAR MULTIPOLE CIRCUIT BREAKER WITH EXTERNAL TRIP CONTROL

[75] Inventor: Russell R. Kosup, Laguna Niguel, Calif.

[73] Assignee: Unicorn Industries, Anaheim, Calif.

[22] Filed: Dec. 16, 1974

[21] Appl. No.: 532,938

[52] U.S. Cl. ..... 335/36; 335/176; 200/50 A

[51] Int. Cl.[2] ..... H01H 75/02

[58] Field of Search ..... 335/10, 9, 35, 36, 38, 335/175, 176; 200/50 A

[56] References Cited

UNITED STATES PATENTS

| | | | |
|---|---|---|---|
| 2,875,294 | 2/1959 | Schleicher | 335/175 |
| 3,110,778 | 11/1963 | Edmunds | 200/50 A |
| 3,197,582 | 7/1965 | Norden | 200/50 A |
| 3,864,649 | 2/1975 | Doyle | 335/18 X |

*Primary Examiner*—George Harris
*Attorney, Agent, or Firm*—Christie, Parker & Hale

[57] ABSTRACT

A plurality of single pole breakers, each having a non-conductive housing with parallel sidewalls and mechanically operated release means for actuating the trip mechanism are mounted with the sidewalls of adjacent units in direct contact. A rotatable trip bar extends through the sidewalls and links the release means in each of the units. The outer surface of the sidewalls is recessed around the trip bar opening to form a cavity between adjacent units. A trip lever is positioned in the cavity and attached to the trip bar. A solenoid unit has a mounting flange clamped between the sidewalls with the solenoid plunger engaging the lever to actuate the trip bar and trip the breakers when the solenoid is energized.

8 Claims, 3 Drawing Figures

MODULAR MULTIPOLE CIRCUIT BREAKER WITH EXTERNAL TRIP CONTROL

FIELD OF THE INVENTION

This invention relates to multipole circuit breakers, and more particularly, to an externally attached remote trip mechanism for such circuit breakers.

BACKGROUND OF THE INVENTION

Multiple pole circuit breakers having a remote tripping capability have heretofore been proposed. Such breakers are useful in providing power shut-down from some remote control location. For example, fire, flooding, or other hazards that cut off direct access to a breaker panel may make it desirable to shut off power from another location. Solenoid or other remotely controlled actuating means have been used to activate the trip mechanism of the breakers to interrupt the power. Such known arrangements have required a special breaker with the solenoid or other actuating means incorporated into the breaker unit. As a result, cost of the breaker is substantially increased over breakers without this feature.

SUMMARY OF THE INVENTION

The present invention is directed to a multipole breaker in which the remote control feature can be added on externally to a standard breaker, so that a customer has the option of incorporating a remote control capability at any time even after initial installation of the breaker. In addition to the remote trip, low voltage or ground fault control can also be added externally to the breaker at any time as an optional feature.

This is accomplished, in brief, by providing a multipole breaker comprising a plurality of self-contained breaker units mounted in side-by-side relationship with a trip bar extending through the adjacent sidewalls of the units to provide linkage for tripping all the units in response to an overload trip of any of the units. A recess in the outside of the walls of the units around the trip bar permits a lever to operate the trip bar between the units. A removable solenoid is mounted to the outside of the units and has a plunger engaging the lever between the units for activating the trip bar to trip all the units.

BRIEF DESCRIPTION OF THE DRAWINGS

For a better understanding of the invention reference should be made to the accompanying drawing wherein.

DETAILED DESCRIPTION

Figure 1:
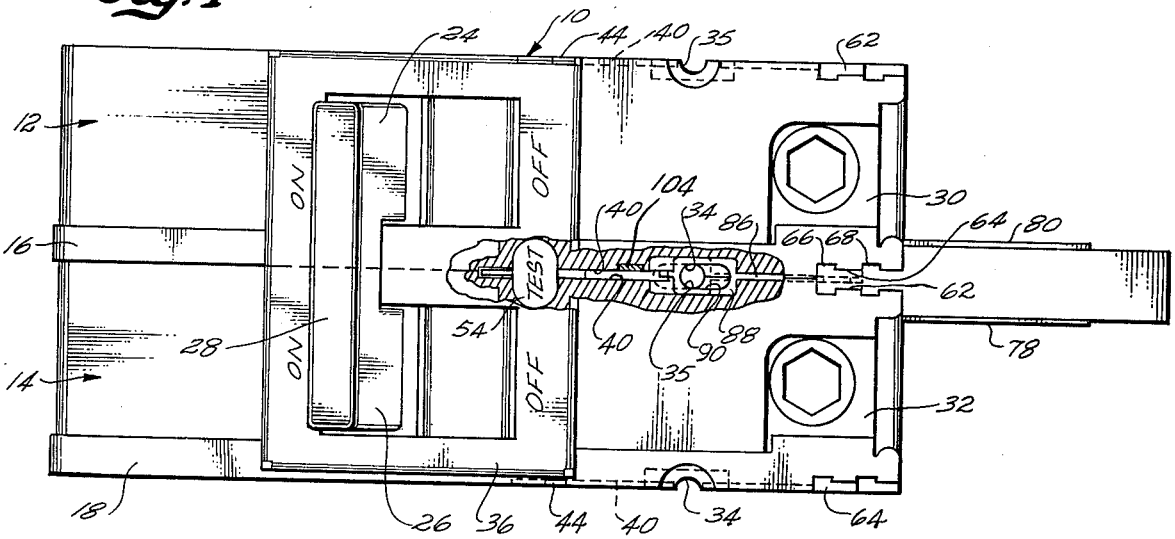
FIG. 1 is a top view of a circuit breaker incorporating the features of the present invention.

Referring to the drawings in detail, the numeral 10 indicates generally a two-pole circuit breaker which is assembled from two single-pole circuit breaker units 12 and 14. Each single pole unit includes a molded plastic housing with a removable cover plate forming one side of the housing, as indicated at 16 and 18, respectively. The circuit breaker is designed to connect to an electrical power source through spring contacts 20 and 22 positioned in slots running transversely of the circuit breaker, the contact springs 20 and 22 engaging bus bars when the circuit breaker is mounted in a suitable service box.

Each breaker unit includes an On/Off handle, as indicated at 24 and 26, the handles being linked together by a connecting bar 28 so that the two circuit breaker units operate as a single two-pole breaker. Outputs from the two-pole breaker are from a pair of binding posts 30 and 32. Each of the cover plates 16 and 18 has a groove 34 on the outer surface extending from the front to the back edge of the breaker. The side of the housing opposite the cover plate has a similar groove 35. The grooves 34 and 35 of adjacent breaker units form a hole when two single pole breaker units are placed in side-by-side position. This is used to insert an elongated screw for bolting the circuit breaker units in place in the service box. A metal plate 36 bridges the two circuit breaker units and is held in place by bending two edges 37' of the plate around lips 39 molded in the housing on either side of the handles. The plate 36 is provided with openings through which the handles 24 and 26 project.

As thus far described, the two-pole circuit breaker is a conventional device sold on the market by various manufacturers of circuit breakers. Suitable circuit breakers for multipole operation are also described in U.S. Pat. Nos. 2,692,926 and 2,878,332. Each single pole breaker unit has an internal trip mechanism responsive to overload conditions. The trip mechanism of the breaker units in a multipole circuit breaker are internally linked together so that if the trip mechanism in any one of the single pole units is subject to an overload condition, all of the units in the multipole breaker are tripped simultaneously. Internal linking of the trip mechanism in the several units comprising the multipole breaker is provided by a suitable cross-link mechanism which extends between the units. Typically this mechanism is in the form of a cross-link bar 38 of insulating material which passes through the sidewalls of the housings of the adjacent single pole breaker units and ties into the internal trip mechanism of each of the single pole units of the multipole breaker. While this linkage may take several forms, as shown by the respective patents identified above, in one known type of breaker being presently sold the bar is generally of non-circular cross-section, at least over a portion of its length where it extends outside of the housing of the single pole breaker units. Rotation of the trip bar 38 in a counter-clockwise direction, as viewed in FIG. 2, causes the internal tripping mechanism for each of the linked breaker units to be actuated, in the manner described in detail in the above-identified patents.

According to the present invention, a test feature and a remote tripping feature that can be incorporated at the option of the user are provided in a multipole unit of the type described above. This is achieved by providing in both the sidewalls of each single pole breaker unit on the outside surface thereof a substantially rectangular recessed area 40. The recessed area 40 has a raised portion 42 which acts as a stop lug and guide, as will hereinafter become apparent. A slot 44 extends out to the front of the breaker. A hole 46 is provided in the plate 36 directly opposite the slot 44. It will be appreciated that when the two single pole breaker units 12 and 14 are placed in side-by-side position, the rectangular recesses 40 in the adjacent outside surfaces combine to form a substantially rectangular cavity between the two units while the slots 44 form a substantially rectangular shaped hole or opening extending from this cavity out to the front of the multipole circuit breaker. Before the single pole units 12 and 14 are brought together, a Z-shaped plunger element, indicated generally at 48, is positioned with an upper straight shank portion 50 lying in the slot 44. A lower shank portion 52 is positioned between the guide lug 42 and the margin of the rectangular recess 40. A push-button knob 54 is attached to the outer end of the upper shank portion 50 and has a skirt portion which extends through the opening 46 in the plate 36.

The lower shank portion 52 of the plunger element 48 engages the outer end 56 of a trip lever 58. The trip lever 58 has a rectangular opening 60 through which the cross-link bar 38 passes.

Thus when the single pole breaker units 12 and 14 are brought together, the Z-shaped plunger 48 is slidably supported in the opposing slots 44. Pressing on the button 54 causes a counter-clockwise rotation of the trip lever 58, which in turn rotates the cross-link bar 38, which in turn activates the trip mechanism in the respective single pole breaker units to trip the breaker units. The button 54 thereby provides a means for testing whether the internal trip mechanism of each of the single pole breaker units is in good working order. The trip mechanisms after being triggered by the test button 54 can be reset in conventional manner by moving the handles 24 and 26 to the OFF position and then back to the ON position.

Figure 2:
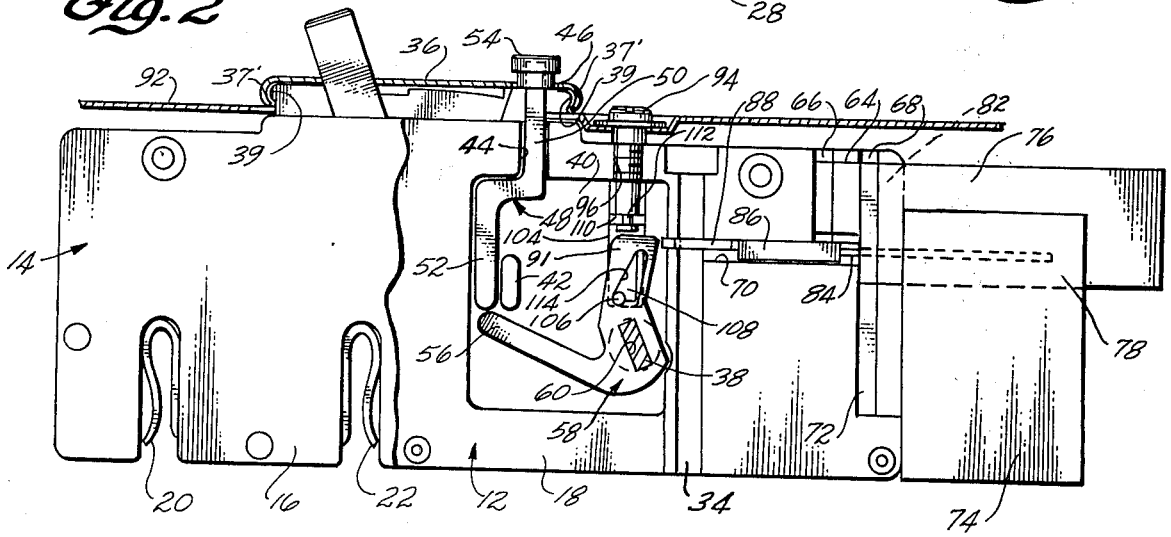
FIG. 2 is a side view partially cut away to show details of the invention.

In order to provide remote tripping and/or tripping in response to a ground fault, the cover plates 16 and 18 and the opposite widewalls of the housing of the units 12 and 14 are recessed along one edge, as indicated at 62 and 64. The recesses 62 and 64 of adjacent surfaces of two single-pole breaker units form an open slot down one end of the breaker 10. The open slot has a pair of parallel grooves 66 and 68. The grooves 66, as shown in FIG. 2, extend downwardly from the front of the circuit breaker housing to a horizontal opening 70 formed by two mating slots. The channels intersect the grooves 34 and 35 at the inner end. The grooves 68 extend from the front of the circuit breaker housing to a point short of the back surface of the circuit breaker.

The slot formed by the adjacent recesses 62 and 64 and grooves 68 receives a T-shaped guide 72 projecting from one side of a rectangular housing unit enclosing an encapsulated ground detector circuit 74. The ground fault detector circuit is of conventional solid state design, such as described in U.S. Pat. No. 3,213,321. Inserted in the slot formed between the two circuit breaker units 12 and 14 above the encapsulated ground detector circuit 74 is an encapsulated solenoid 76. The top of the encapsulated ground detector circuit 74 includes a pair of flanges 78 and 80 which form a channel into which the housing of the solenoid 76 is held. The solenoid 76 has a mounting key 82 which engages the slot formed by recesses 62 and 64 and the grooves 66 and 68 to hold the solenoid in place. The solenoid includes a plunger 84 which engages a trigger actuating member 86 that is slidably supported in the horizontal opening 70 formed by slots in the sidewalls of the breaker units. The trigger actuating member 86 includes a portion 88 which is wider than the diameter of the opening formed by the semicircular slots 34 and 35. The portion 88 is provided with an elongated slot 90 through which a bolt or pin can pass.

When the solenoid 76 is energized, the plunger 84 is moved to the left, as viewed in FIG. 2, forcing the member 86 to the left into contact with an arm 91 integral with the tripping lever 58. When energizing, the solenoid causes the tripping lever 58 to be rotated in a counter-clockwise direction which in turn rotates the bar 38 for actuating the internal trip mechanism of each of the circuit breaker units.

The solenoid 76 can be energized from a remote source in conventional manner using any suitable low voltage power source. In addition the solenoid 76 can be operated by the ground fault detector circuit 74. Where it is desired to use the solenoid 76 without the ground fault detector circuit 74, a dummy housing can be inserted in place of the encapsulated ground circuit detector 74.

From the above description it will be seen that by molding the rectangular recess 40, horizontal channel 70, and recess is 62 and 64 with the slots 66 and 68 in the outer sidewalls of the housing for each of the circuit breaker units, the remote control tripping mechanism can be added to modify a pair of single-pole circuit breaker units by inserting the trip lever 58 and trigger member 86 in position before the circuit breaker units are mounted in side-by-side relationship. After the circuit breaker units are mounted, the ground fault detector circuit 74 and solenoid 76 are added by sliding the key members 72 and 82 into the slot formed between the adjacent sidewalls of the two circuit breaker units. The test facility can be added by merely inserting the slide member 48 in position in the groove 44 and adding the plate 36 and button 54. No modification of the active parts of the circuit breaker units themselves is involved, so that the individual circuit breaker units can still be used at the option of the purchaser as conventional circuit breakers. Conversion to additional operation of the breakers by remote control and/or by sensing of either a low voltage condition for electrical equipment protection or a ground fault personnel protector can be added at any time to the breaker units before or after installation.

Figure 3:
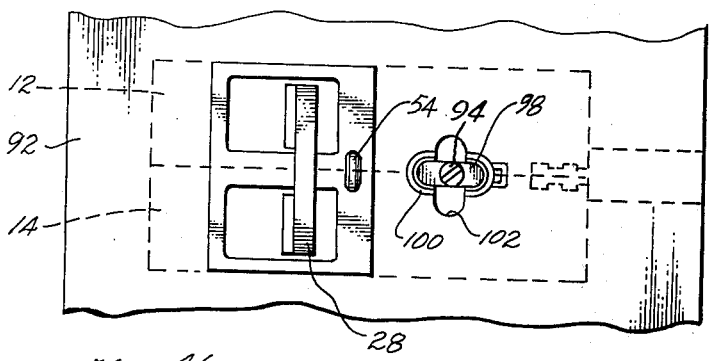
FIG. 3 is a partial front view of the breaker mounted behind the panel.

The circuit breakers are normally mounted in a service box (not shown) which has a cover or panel 92 that encloses the breakers and the bus bars and wiring to which the breakers are connected. To provide a safety interlock so that the breakers are tripped whenever the front plate is removed, the front panel 92 is retained by a screw 94 which threadably engages a threaded hole 96 provided at the interface between the two circuit breaker units 12 and 14. An oblong washer 98 fits under the head of the screw 94. When the washer is aligned, as indicated in FIG. 3, it is seated in a depression 100 in the panel 92. However, by loosening the screw 94, the oblong washer 98 can be lifted out of the recess 100 and rotated through 90° so as to be aligned with an elongated slot 102 in the panel 92. This permits the panel 92 to be lifted off over the washer 98.

The screw 94 provides an interlock arrangement which automatically trips the breakers when the panel 92 is removed. This is accomplished by means of a slide member 104 positioned in a vertical groove formed in the recess area 40 in the side wall of one of the breaker units. The slide member 104 has a pin 106 which projects through a slot 108 in the trip lever 58. The upper end of the slide member 104 has a slotted projection 110 which engages an annular groove 112 in the lower end of the screw 94. Thus as the screw 94 is backed off to remove the panel 92, the slide member 104 is moved upwardly by the screw as viewed in FIG. 2. This causes the pin 106 to engage an edge 114 of the slot 108, producing a wedging action which rotates the trip lever 58 in a counter-clockwise direction as viewed in FIG. 2. This rotation of the trip lever 58, as described above, operates to trip both breaker units, thereby providing a safety interlock for the panel. The safety interlock insures that the panel 92 cannot be removed to expose the wiring without the circuit breakers first being tripped off.

What is claimed is:

1. Multiple circuit breaker apparatus comprising a plurality of electric circuit breaker units, each breaker unit including a nonconductive housing, an overload current responsive trip mechanism and release means for mechanically operating the trip mechanism to trip the breaker, the housing of adjacent breaker units having adjacent parallel walls in contact with each other; a trip bar extending through said parallel walls and linking the release means in each of the units, rotation of the trip bar actuating the release means in each of the breaker units to mechanically operate the trip mechanisms and trip each of the breaker units; an external trip lever connected to the trip bar between adjacent parallel walls of adjacent units outside the housing of said units; and external trip means mounted outside the housing and operatively associated with said trip lever for rotating the trip lever and trip bar to trip all the breaker units connected by the bar.

2. Apparatus of claim 1 wherein said external trip means includes a manually operated push button for operating the external trip lever.

3. Apparatus of claim 1 wherein said external trip means includes a solenoid and plunger movable by the solenoid, the plunger operating the external trip lever.

4. Apparatus of claim 3 further including means for detachably mounting the solenoid to the breaker units with the plunger extending between the sidewalls of the adjacent breaker housings.

5. Apparatus of claim 4 wherein the parallel sidewalls of the adjacent breaker units have mounting slots extending therein, the solenoid having a mounting member slidable in said slots.

6. Apparatus comprising a pair of circuit breaker units having overload trip mechanisms, each breaker unit including an insulating housing fully enclosing the trip mechanism, means including a cover for mounting the units in side-by-side relationship with the cover extending across the front of the two breaker units, a rotating trip bar extending between the two units for coupling the trip mechanisms together, a trip lever connected to the bar in a space between the housings of the two breaker units, and means interconnecting the cover and the trip lever for moving the trip lever to rotate the trip bar and actuate the trip mechanisms when the cover is removed.

7. Apparatus of claim 6 further including a manually operated button projecting beyond the cover, and linkage means connecting the button to the trip lever between the two breaker units for tripping both units when the button is moved.

8. Apparatus of claim 6 further including solenoid means mounted outside the breaker units, and linkage means connecting the solenoid to the trip lever for tripping both units when the solenoid is actuated.

* * * * *